United States Patent [19]

Gold

[11] 4,023,862

[45] May 17, 1977

[54] HYDRAULIC MINING AND TRANSPORTATION OF COAL USING HOT OIL UNDER PRESSURE

[76] Inventor: Louis Gold, 2725 39th St., NW., Washington, D.C. 20007

[22] Filed: Dec. 24, 1975

[21] Appl. No.: 644,007

[52] U.S. Cl. ..... 299/14; 299/17; 299/18; 299/30

[51] Int. Cl.² ..... E21C 41/00

[58] Field of Search ..... 299/14, 17, 18; 44/1 B, 44/51; 302/66

[56] References Cited

UNITED STATES PATENTS

| | | | |
|---|---|---|---|
| 2,678,203 | 5/1954 | Huff | 299/17 X |
| 3,129,164 | 4/1964 | Cameron | 302/66 X |
| 3,790,214 | 2/1974 | Kilroy | 299/18 X |

*Primary Examiner*—Ernest R. Purser
*Attorney, Agent, or Firm*—Sughrue, Rothwell, Mion, Zinn & Macpeak

[57] ABSTRACT

The method of mining coal entails the use of crude petroleum under high pressure together with elevated temperatures in hydraulic fashion to produce a hybrid oil-coal fuel. A powerful stream of oil is aimed at sections of coal strata to disintegrate the coal. The resultant slurry can be recycled for reuse in the mining operation with provisions being made for screening out the larger coal particles. When the oil-coal slurry reaches the desired consistency, it can be pumped for storage or pipeline delivery to consumers or processing plants.

1 Claim, 2 Drawing Figures

HYDRAULIC MINING AND TRANSPORTATION OF COAL USING HOT OIL UNDER PRESSURE

BACKGROUND OF THE INVENTION

1. Field of the Invention

The present invention is directed to hydraulic mining, and more specifically the hydraulic mining of coal while using pressurized oil at elevated temperatures and the subsequent transportation thereof by pipeline.

2. Prior Art

Hydraulic mining systems which utilize water under pressure are old and well known in the art. In such systems, the ore is generally loosened or disintegrated by the force of the water and the resultant slurry is piped to the surface for separation. However, such separation procedures are extremely costly and time consuming, and in certain instances the ore must be fully dried before it is useable in the further processing.

The chemical mining of coal is also known in the art wherein the coal seam is exposed to hydrogenating agents to produce a liquid product or other compounds which will weaken the interlayer forces at natural interfaces present in the coal to disintegrate the seam into fragments. Such chemical processes are very expensive due to the cost of the chemicals involved.

The use of oil for under water mining of mineral deposits is known wherein the loosened material will float to the surface of the water with the oil for recovery. However, such a system requires extremely large and complicated retaining devices to limit the floating oil and minerals to a restricted surface area and the cost of separating the water from the oil minerals renders such a process prohibitively expensive.

Finally, although the existence of coal/oil suspensions are known per se and although slurrys of coal and water have been transported long distances by pipeline no one has contemplated the production of the coal/oil suspension in situ at the coal seam by utilizing a jet of oil under pressure and the subsequent direct transportation of the coal oil slurry or suspension by means of a pipeline.

SUMMARY OF THE INVENTION

The present invention provides a safe economical coal mining method wherein the coal seam is disintegrated by utilizing a jet of hot oil under pressure. Such an operation can be remotely controlled in a deep mine shaft thereby eliminating the need for personnel in a hazardous underground environment and further reduces the production of coal dust which would present the added hazard of explosion.

The present invention provides a unique method of producing a coal/oil slurry in situ at a coal mine and also provides unique method of directly transporting the slurry by pipeline to a remote location for direct use or further processing.

The foregoing and other objects, features and advantages of the invention will be apparent from the following more particular description of a preferred embodiment of the invention as illustrated in the accompanying drawings.

DETAILED DESCRIPTION OF THE PREFERRED EMBODIMENTS

Coal mining today, especially in the deep underground mines, is an extremely hazardous occupation fraught with such dangers as explosions, fires, black lung disease and the like. In an effort to provide minimum occupational safeguards for the miners it has been necessary for mine operators to add extremely expensive equipment in the mines thereby raising the cost of the coal produced. Many attempts have been made to automate the coal mining industry but the development of practical fully automatic equipment at a reasonable cost has never been satisfactorily achieved. The present invention contemplates a completely automated mining operation as shown in FIG. 1 by utilizing a jet of hot oil under pressure to disintegrate the coal seam whereby the resultant coal/oil slurry can be pumped to the surface.

Figure 1:
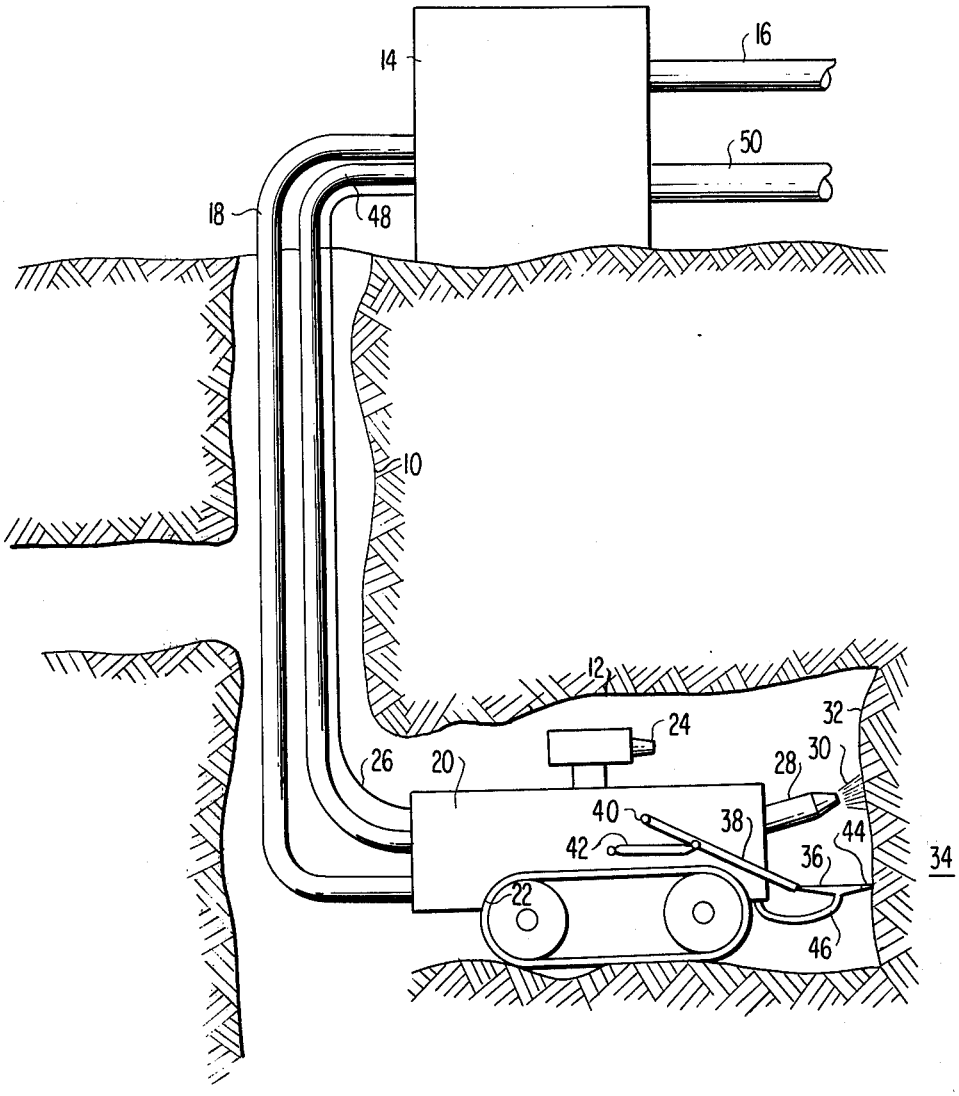
FIG. 1 is a schematic view showing an underground coal mining installation using the system according to the present invention.

FIG. 1 is a schematic view of an underground mine having a vertical shaft 10 and a horizontal passageway 12 branching off therefrom. The size of the shaft, the number of lateral passageways and the presence or absence of a hoist in the vertical shaft can vary depending upon the particular mine site. Since the technology for the hydraulic mining of minerals utilizing water as the fluid means are old and well known and since the same apparatus can be substantially used with minimum modifications for the present invention wherein hot oil is used as the fluid medium the details of the equipment will be kept to a minimum in the present application.

A suitable pumping station 14 is provided on the surface for receiving a supply of oil from any suitable source through the pipe 16. The pumping station 14 may include suitable means for heating the oil or the heating of the oil can be achieved solely by the friction of the oil during the pumping and transporting operation. The oil is pumped downwardly through the vertical mine shaft 10 through a suitable conduit 18 which is connected as lower end to a movable mining machine 20. Such remotely controlled mining machines are old and well known in the art and generally travel on endless tracks 22. The machine 20 can be propelled by a hydraulic motor which may be driven by the oil under pressure in the conduit 18 and a TV camera 24 can be mounted on the machine for transmitting a picture of the operation to the surface so that appropriate guiding signals can be transmitted to the machine 20 through the electrical cable 26.

The mining machine is provided with a variable direction nozzle 28 through which a pressurized stream of oil 30 may be directed against the face 32 of the coal seam 34. By turning the machine 20 and varying the angle of the nozzle 28 the entire face of the coal seam can be attacked with the high pressure stream of oil to pulverize or disintegrate the coal.

Although the coal/oil slurry can be allowed to accumulate on the floor of the horizontal passage 12 for subsequent pumping to the surface it is contemplated that the machine 20 according to the present invention could be provided with a concave collection plate 36 which may be mounted on a pair of movable arms 38 which are pivoted to the machine 20 at 40 and controllable by means of conventional hydraulic pistons 42 at each side. The front edge of the collection plate 36 may be provided with a flexible lip 44 of rubber or any other suitable material so that a relatively close fit may be achieved between the collection plate and the face of the coal seam. A fluid outlet is provided at the lowest point in the concave plate 36 and a conduit 46 is connected thereto for pumping the oil back to the machine 20. The pump in the machine 20 then pumps the slurry through the conduit 48 to the pumping station 14 on the surface.

At the pumping station 14 suitable screening means may be provided to screen out the larger coal particles and the remaining coal/oil slurry can be recycled, that is, pumped down the conduit 18 for further use in the mining operation. When the coal/oil slurry being returned to the surface through the conduit 48 reaches the desired consistency the slurry can then be pumped through a pipeline 50 to temporary storage means or may be moved to points adjacent the market areas of the respective components and processed at those points to recover the coal and oil constituents. It is also possible to directly use the coal/oil slurry or a portion thereof directly in a combustion process as is old and well known in the art.

Although the foregoing embodiment of the invention describes the method in conjunction with a subsurface coal mine it is also contemplated that the present method could be applied to strip mining operations wherein the coal/oil slurry would be directly formed at the exposed seam of coal and transported by pipeline for subsequent use. The economics of the present invention are extremely attractive especially in areas having a readily available supply of both oil and coal. Even in those areas where it is necessary to transport the oil to the coal deposits the method is extremely attractive due to the enhanced safety value achieved by removing the miners from the hazardous deep mine environment.

Figure 2:
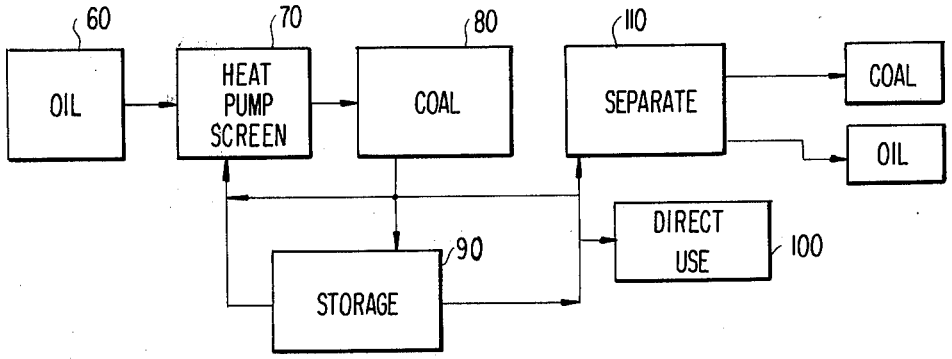
FIG. 2 is a schematic flow chart showing the sequence according to the present invention.

The schematic flow of the materials according to the present invention is illustrated in FIG. 2 wherein the oil 60 is delivered to a heating pumping and/or screening station 70. The hot oil under pressure is then impinged directly on the supply of coal 80 and the resultant slurry can then be pumped back to the station 70 for recycling, pumped to temporary storage means 90 or pumped directly to a market area for direct use 100 or to a separation plant 110 for separation into the coal and oil constituents.

While the invention has been particularly shown and described with reference to a preferred embodiment thereof it will be understood by those in the art that various changes in form and details may be made therein without departing from the spirit and scope of the invention.

What I claim is:

1. A method of mining and transporting coal comprising heating and pumping a supply of oil under pressure to a body of unmined coal, directing a jet of said oil under pressure against said body of coal to disintegrate said coal and form a slurry of coal and oil, screening said slurry of coal and oil to remove the larger pieces of coal, recycling the slurry of coal fines and oil through the foregoing steps until said slurry reaches the desired consistency and pumping said slurry of desired consistency to a desired destination via pipeline.

* * * * *